US010794629B2

(12) United States Patent
Wilson et al.

(10) Patent No.: US 10,794,629 B2
(45) Date of Patent: Oct. 6, 2020

(54) NEGATIVE PRESSURE SENSING FOR AN APPLIANCE DOOR CLOSURE

(71) Applicant: Midea Group Co., Ltd., Beijiao, Shunde, Foshan (CM)

(72) Inventors: Mark W. Wilson, Simpsonville, KY (US); Eric Scalf, Louisville, KY (US)

(73) Assignee: MIDEA GROUP CO., LTD., Beijiao, Shunde, Foshan, Guangdong (CN)

( * ) Notice: Subject to any disclaimer, the term of this patent is extended or adjusted under 35 U.S.C. 154(b) by 95 days.

(21) Appl. No.: 16/024,103

(22) Filed: Jun. 29, 2018

(65) Prior Publication Data

US 2020/0003483 A1 Jan. 2, 2020

(51) Int. Cl.
*F25D 29/00* (2006.01)
*F25D 23/02* (2006.01)

(52) U.S. Cl.
CPC ..... *F25D 29/005* (2013.01); *F25D 23/028* (2013.01); *F25D 29/008* (2013.01); *F25D 2600/04* (2013.01)

(58) Field of Classification Search
CPC ..... F25D 23/028; F25D 29/008
See application file for complete search history.

(56) References Cited

U.S. PATENT DOCUMENTS 4,891,626 A 1/1990 Neuman
5,327,729 A 7/1994 Yanai et al.
5,460,010 A * 10/1995 Kobayashi ..... F25D 17/045 62/187
5,479,152 A * 12/1995 Walker ..... F25D 29/008 200/61.62
6,522,252 B2 * 2/2003 Horibe ..... G01L 19/0038 200/83 A
7,005,983 B2 2/2006 Holmes et al.
7,021,149 B2 * 4/2006 Dannhauer ..... G01L 19/0609 73/716
8,225,458 B1 * 7/2012 Hoffberg ..... E05F 3/102 16/49
8,638,224 B2 1/2014 Park
9,644,879 B2 5/2017 Broadbent
(Continued)

FOREIGN PATENT DOCUMENTS

CN 102410693 A 4/2012
CN 104329906 A 2/2015
(Continued)

OTHER PUBLICATIONS

Machine Translation of WO2016/192990 to Kempfle, eSpacenet, "Domestic Appliance Comprising Differential Pressure Sensor", description (Year: 2016).*
(Continued)

*Primary Examiner* — Filip Zec
(74) *Attorney, Agent, or Firm* — Middleton Reutlinger

(57) ABSTRACT

A system for measuring and monitoring the closure of a refrigerated compartment of an appliance includes a controller having at least one input and at least one output for receiving and providing electrical signals to a plurality of electrical components of the appliance. The system includes a pressure sensor for monitoring the compartment to detect the presence of a negative pressure pulse indicative of a compartment closure.

20 Claims, 6 Drawing Sheets

(56) References Cited

U.S. PATENT DOCUMENTS

| | | | | |
|---|---|---|---|---|
| 10,260,795 | B2 * | 4/2019 | Giacomini | F25D 23/028 |
| 2005/0086952 | A1 | 4/2005 | Nonaka et al. | |
| 2005/0092094 | A1 * | 5/2005 | Kussel | G01L 9/0089 73/730 |
| 2008/0006041 | A1 | 1/2008 | Nakata | |
| 2014/0250925 | A1 | 9/2014 | Prabowo et al. | |
| 2016/0116206 | A1 | 4/2016 | Kempfle et al. | |
| 2016/0313055 | A1 | 10/2016 | Heydel | |
| 2016/0363364 | A1 | 12/2016 | Kempfle | |
| 2016/0377339 | A1 | 12/2016 | Kempfle | |
| 2018/0155975 | A1 * | 6/2018 | Kempfle | E05F 15/611 |

FOREIGN PATENT DOCUMENTS

| | | | |
|---|---|---|---|
| CN | 204329463 | U | 5/2015 |
| CN | 105222507 | A | 1/2016 |
| CN | 205090718 | U | 3/2016 |
| DE | 3412972 | A1 | 10/1985 |
| DE | 10063681 | A1 | 7/2002 |
| DE | 102011108499 | A1 | 1/2013 |
| DE | 102015100053 | A1 | 7/2016 |
| EP | 0719995 | B1 | 7/2004 |
| JP | 5720704 | A | 7/2014 |
| KR | 100182649 | B1 | 5/1999 |
| WO | WO2005028972 | A1 | 3/2005 |
| WO | WO2016192990 | A1 | 12/2016 |

OTHER PUBLICATIONS

International Search Report and Written Opinion issued in Application No. PCT/CN2019/091493 dated Sep. 18, 2019.

* cited by examiner $$\frac{P_1V_1 = n_1RT_1}{P_2V_2 = n_2RT_2}$$

$V_1 = V_2$ FULL VOLUME EXCHANGE $n_1 = n_2$ MASS CONSTANT (NO INFILTRATION)

R = CONSTANT $$\frac{P_1}{P_1} = \frac{T_2}{T_2}$$

$T_1$ = AMBIENT = 75°F = 535°R $T_1$ = 0°F = 460°R $P_1$ = ATMOSPHERE = 14.69lb/in$^2$ $$P_2 = \frac{P_1 T_2}{T_1} = \frac{(14.69\text{lb/in}^2)(535°\text{R})}{460°\text{R}} = 12.63\text{lb/in}^2$$

or $\Delta P = 2.06\text{lb/in}^2$

*FIG. 2*

$$F = \Delta PA$$
$$= 2lb/in \times (27 \times 36)in^2$$
$$= 1944lbs$$

NEGATIVE PRESSURE SENSING FOR AN APPLIANCE DOOR CLOSURE

BACKGROUND

In appliance manufacturing industries generally, and specifically in the manufacture of refrigeration appliances such as refrigerators, freezers and ice machines, maintaining a constant operating temperature is of paramount importance. In many of these appliances the freezer and refrigerator doors are designed to seal tightly so that the refrigeration system can operate to efficiently maintain temperature. However, refrigerator and freezer doors often appear to be closed when they are slightly open, which naturally causes the appliance to consume excessive electricity in an attempt to maintain temperature, and often leads to thawed food, spoilage, and frost buildup on the food, interior compartments and the refrigeration system evaporator. These issues can be particularly acute when a refrigeration unit is used in a public accommodation such as a restaurant kitchen, since spoiled food has the potential to impact more people than in a residential setting.

Prior art refrigeration appliance door closing detection systems vary widely in design but often utilize mechanically operated proximity switches that are mounted such that the door opening (or closing) physically opens or closes the switch to detect an open or closed door. In some systems the switch may be wired to a controller or microprocessor that operates to provide an audible or visual alarm when a door is opened or closed. However, proximity switches can easily become worn or misaligned over time and malfunction. When this happens the user typically begins to ignore any audio or visual feedback provided by the appliance, and thus it is difficult to detect an open door. Additionally, when a refrigeration compartment seal begins to fail due to door misalignment or worn sealing components, the door may in fact be completely closed but the appliance doesn't have the ability to detect the failure. Furthermore, many prior art systems don't use any door open detection or alarm system, primarily due to expense and reliability concerns.

From the foregoing it can readily be seen that there is a need in the art for a door closure sensing system in a refrigeration appliance that detects an open door and alerts a user to the opening without adding significantly to the cost and complexity of the appliances. Furthermore, there is a need for a door closure system that is capable of detecting improper closure or an improperly sealed refrigeration compartment.

SUMMARY

The present disclosure is related to systems and methods for detecting an open door in a refrigeration appliance. The system described herein utilizes a controller and/or processor either integral to or separate from the appliance to monitor requested pressure within a sealed compartment or compartments in the appliance. When a refrigerator or freezer compartment is closed a negative pressure is created within the compartment that may then be sensed and analyzed by the systems and methods disclosed herein.

In various embodiments and aspects, the methods and apparatus disclosed herein provide a system that senses pressure inside a refrigeration compartment and compares the pressure therein over a predetermined time period to an ideal or target pressure profile. In some aspects a target pressure profile for a compartment or compartments may be stored in data memory in the form of a data chart or look-up table in that is readily accessed by a processor. In some aspects and embodiments exemplary but non-limiting characteristics may include individual pressure profiles for each sealed refrigeration compartment within an appliance. In other aspects and embodiments a target pressure profile to determine an open compartment door may include a plurality of pressure characteristics such as a pressure drop magnitude upon closing the compartment, a pressure drop duration, and a pressure rise or return rate after the door is closed and the pressure inside the compartment equalizes. In various aspects and embodiments a comparison of the target pressure profile for a compartment may determine whether the compartment is open, closed, partially opened (or closed), or even in need of maintenance.

In other embodiments, the system and methods disclosed herein may be used to store in data memory historical data regarding an individual compartment's pressure profile characteristics such that a target pressure profile may be determined by an iterative or machine learning process. Additionally and alternatively the system and methods disclosed herein may be used to provide customized target pressure profiles for individual refrigeration compartments. In some exemplary but non-limiting embodiments, a target pressure profile may be established during production and manufacturing of an appliance, such that each compartment of an appliance is sold or shipped with an individual target pressure profile pre-stored in data memory. These individual compartment profiles may then be updated and modified over time, as more door closing events are monitored by a controller or processor.

In other embodiments and aspects the system and methods disclosed herein may incorporate a mechanical door closure switch to note the occurrence of a door closure event for a compartment, and a pressure sensor to note the change in pressure over time in the compartment to verify a good door closure, or note a poor door closure or seal failure.

In other embodiments set forth herein a mechanical flap assembly may be provided in a portion of a refrigerated compartment, wherein the negative pressure pulse created by the compartment door closing operates the flap assembly, providing an input to a processor to indicate proper door closure. In some aspects the flap assembly may act as a vacuum break for the compartment, thereby providing easier door operation for a user.

As used herein for purposes of the present disclosure, the term "appliance" or "refrigeration appliance" should be understood to be generally synonymous with and include any device that refrigerates food or any material and that includes at least one closed compartment, or a plurality thereof, for storing and refrigerating items. The appliances referred to herein may include a processor or processors that operate the appliance.

The term "controller" or "processor" is used herein generally to describe various apparatus relating to the operation of the system and the appliances referred to herein. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), programmable logic controllers (PLCs), and field-programmable gate arrays (FPGAs).

A processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present disclosure discussed herein. The terms "program" or "computer program" are used herein in a generic sense to refer to any type of computer code (e.g., software or microcode) that can be employed to program one or more processors or controllers.

The term "Internet" or synonymously "Internet of things" refers to the global computer network providing a variety of information and communication facilities, consisting of interconnected networks using standardized communication protocols. The appliances, controllers and processors referred to herein may be operatively connected to the Internet.

It should be appreciated that all combinations of the foregoing concepts and additional concepts discussed in greater detail below (provided such concepts are not mutually inconsistent) are part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. The drawings are not necessarily to scale. Emphasis is instead generally placed upon illustrating the principles of the disclosure, wherein;

FIG. 2 is a depiction of an exemplary negative pressure analysis in accordance with various embodiments;

DETAILED DESCRIPTION

Figure 1:
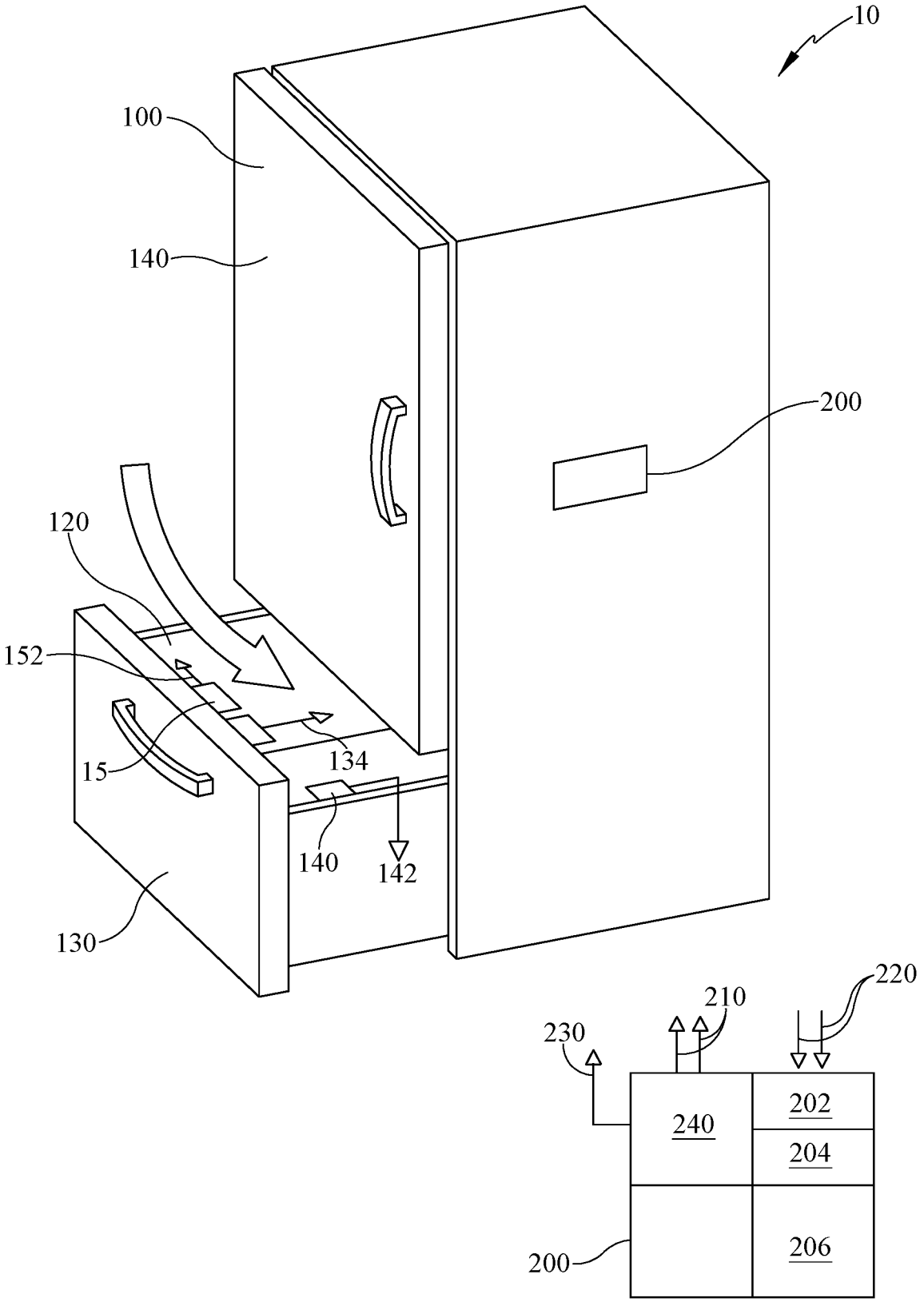
FIG. 1 is a depiction of an appliance and processor in accordance with various embodiments.
Figure 3:
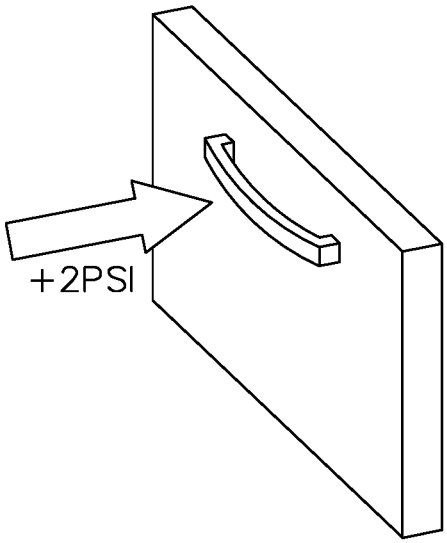
FIG. 3 is a depiction of an exemplary door opening force analysis in accordance with some aspects and embodiments.

Referring to drawing FIGS. 1-3, and in accordance with various aspects and embodiments of the invention, a system 10 for sensing the closure of a refrigerated compartment of an appliance 100 by sensing and monitoring pressure therein is described. In various embodiments the appliance 100 in which system 10 is implemented may include at least one compartment 120 such as a freezer 130 or refrigerator 140 that are relatively airtight when closed, and in which the pressure may be sensed. Compartment 120 may include a door 122 or equivalent closure, that effectively provides a seal from ambient air when door 122 is closed. Throughout this specification in various embodiments the system 10 disclosed will refer to a freezer compartment 130 of an appliance 100, but any sealed compartment 120 may be utilized in the system 10 without departing from the scope of the invention. Furthermore, system 10 may include a controller 200 integral to appliance 100 that operates appliance 100 and implements pressure sensing system 10.

FIG. 1 illustrates an exemplary appliance 100 control hardware environment for implementing system 10 for pressure sensing. The appliance 100 may include a controller 200, a processor or processors 202 and memory 204. Appliance 100 may further comprise a plurality of signal outputs 210 and signal inputs 220 that may be operatively connected to a plurality of appliance 100 components to monitor and direct system 10 operation. Furthermore, in some embodiments controller 200 may include a wireless or hard-wired communications interface 230 that enables controller 200 to communicate with external devices or communications networks such as the internet, that may be integrated into system 10.

Additionally, controller 200 may be equipped with an operator interface 240 to provide audible or visual feedback to a user as well as provide a user the ability to provide instructions or commands to controller 200. Exemplary but non-limiting user interfaces that may be employed include a mouse, keypads, touch-screens, keyboards, switches and/or touch pads. Any user interface may be employed for use in the invention without departing from the scope thereof. It will be understood that FIG. 1 constitutes, in some respects, an abstraction and that the actual organization of the components of appliance 100 and controller 200 may be more complex than illustrated.

The processor 202 may be any hardware device capable of executing instructions stored in memory 204 or data storage 206 or otherwise processing data. As such, the processor may include a microprocessor, field programmable gate array (FPGA), application-specific integrated circuit (ASIC), or other similar devices.

The memory 204 may include various memories such as, for example L1, L2, or L3 cache or system memory. As such, the memory 204 may include static random access memory (SRAM), dynamic RAM (DRAM), flash memory, read only memory (ROM), or other similar memory devices. It will be apparent that, in embodiments where the processor includes one or more ASICs (or other processing devices) that implement one or more of the functions described herein in hardware, the software described as corresponding to such functionality in other embodiments may be omitted.

The user interface 240 may include one or more devices for enabling communication with a user such as an administrator. For example, the user interface 240 may include a display, a mouse, and a keyboard for receiving user commands. In some embodiments, the user interface 240 may include a command line interface or graphical user interface that may be presented to a remote terminal via the communication interface 230.

The communication interface 230 may include one or more devices for enabling communication with other hardware devices. For example, the communication interface 230 may include a network interface card (NIC) configured to communicate according to the Ethernet protocol. Additionally, the communication interface 230 may implement a TCP/IP stack for communication according to the TCP/IP protocols. Various alternative or additional hardware or configurations for the communication interface 230 will be apparent.

The storage 206 may include one or more machine-readable storage media such as read-only memory (ROM), random-access memory (RAM), magnetic disk storage media, optical storage media, flash-memory devices, or similar storage media. In various embodiments, the storage 206 may store instructions for execution by the processor 202 or data upon which the processor 202 may operate. For example, the storage 206 may store a base operating system for controlling various basic operations of the hardware. Other instruction sets may also be stored in storage 206 for executing various functions of system 10, in accordance with the embodiments detailed below.

It will be apparent that various information described as stored in the storage 206 may be additionally or alternatively stored in the memory 204. In this respect, the memory 204 may also be considered to constitute a "storage device" and the storage 206 may be considered a "memory." Various other arrangements will be apparent. Further, the memory 204 and storage 206 may both be considered to be "non-transitory machine-readable media." As used herein, the term "non-transitory" will be understood to exclude transitory signals but to include all forms of storage, including both volatile and non-volatile memories.

While the controller 200 is shown as including one of each described component, the various components may be duplicated in various embodiments. For example, the processor 202 may include multiple microprocessors that are configured to independently execute the methods described herein or are configured to perform steps or subroutines of the methods described herein such that the multiple processors cooperate to achieve the functionality described herein. Further, where the controller 200 is implemented in a cloud computing system, the various hardware components may belong to separate physical systems. For example, the processor 202 may include a first processor in a first server and a second processor in a second server.

Referring now to FIGS. 1-4 and in accordance with some aspects and embodiments, a system 10 for detecting a door 122 closure by monitoring negative pressure utilizes an instruction set provided to processor 202. Processor 202 may also include the instruction set that operates the appliance 100, accepting user inputs 220 from operator interface 240 and actuating or energizing the various components of appliance 200 be operatively coupled outputs 210 as required for normal operation. It should be understood that any appliance 100 or other device that operates with electrical power may be utilized in conjunction with the system 10 without departing from the scope of the invention.

In various aspects and embodiments a pressure sensor 140 is disposed in an interior portion of compartment 120 for sensing the pressure inside the compartment either continuously, or at discrete, frequent intervals. Pressure sensor 140 is typically situated within compartment 120 in a location at which pressure is readily sensed, but which is also relatively protected from impacts from placing and removing items in compartment 120. Pressure sensor 140 includes a signal output 142 that is indicative of the pressure detected by sensor 140 in compartment 120 and further is operatively coupled to an input 220 of processor 200. In other aspects and embodiments, a plurality of pressure sensors 140 may be utilized in a single compartment 120, or alternatively a pressure sensor 140 may be placed in each compartment 120 being monitored. Where a plurality of sensors 140 are disposed in a single compartment 120, in one embodiment the pressure signals 142 therefrom may be averaged by processor 200 to provide an accurate pressure indication.

In various aspects and embodiments a wide variety of pressure sensor 140 types may be used without departing from the scope of the invention. Some exemplary but non-limiting pressure sensors 140 that may be employed in the various embodiments include electromagnetic, capacitive, piezoresistive, thin-film strain gauges, optical, potentiometric, resonant, and thermal pressure sensors.

In further aspects and embodiments, a door switch 150 may be provided, for example a proximity switch, microswitch or other mechanically operated switch, having an output 152 indicative of door closure that is operatively coupled to an input 220 of processor 200. Door switch 150 may be used as an indication that an attempt to close door 120 has been made, since proximity switches and other mechanical closure switches can indicate door 122 closure even when the door 120 seal is imperfect and the door 122 is slightly ajar.

Figure 4:
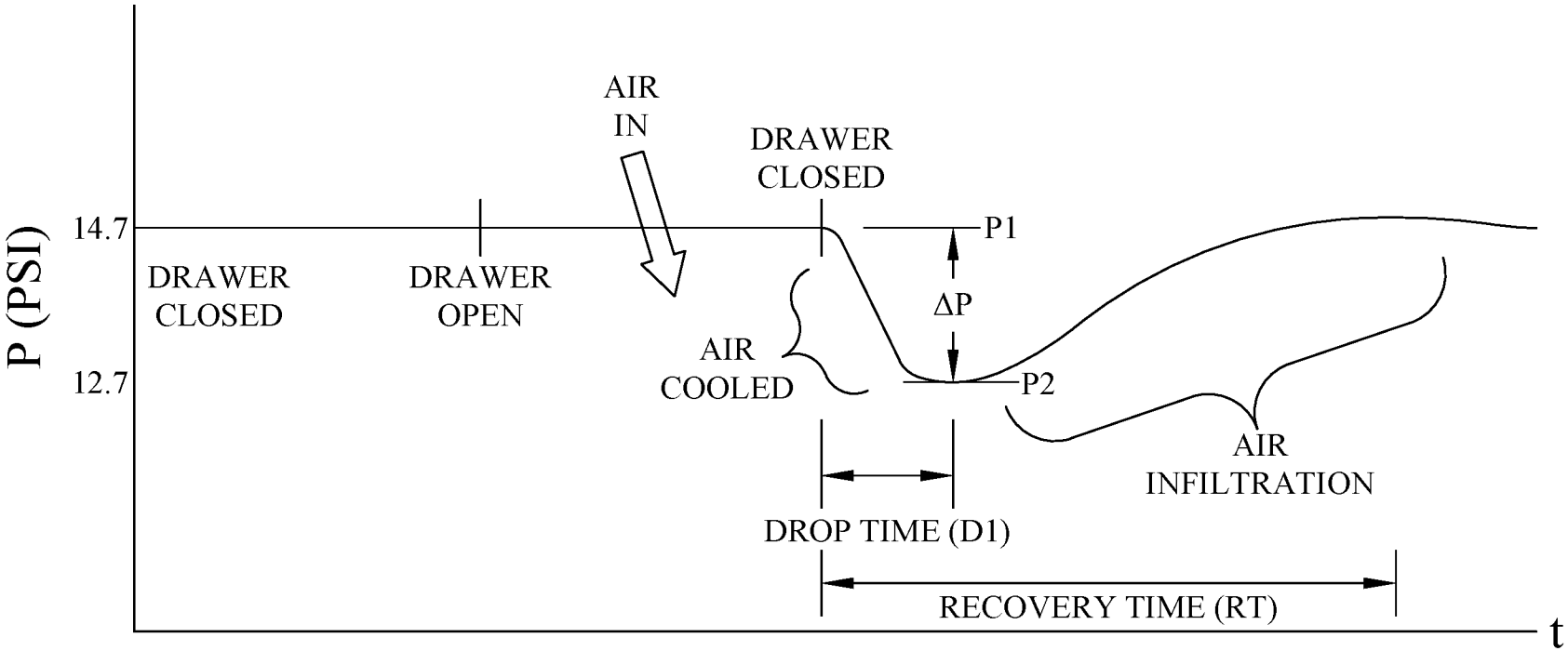
FIG. 4 is a depiction of an exemplary negative pressure analysis in accordance with some aspects and embodiments.

Referring again to FIGS. 1-4 in various aspects and embodiments pressure signal 142 is monitored by processor 200 at a predetermined sampling rate to continuously monitor the magnitude of the pressure P in compartment 120. When compartment 120 door 122 is opened and then closed again, a negative pressure pulse is typically created upon door 122 closure as the warmer ambient air that rushes into the previously sealed compartment 120 is quickly re-cooled upon compartment 120 closure. This negative pressure within the compartment 120 is determined by the operation of Boyle's law (the ideal gas law) and is depicted in the compartment 120 pressure analysis in FIG. 2. An exemplary pressure profile for a compartment 120 is depicted in FIG. 4, wherein the pressure inside compartment 120 is shown to be relatively stable and near sea level atmospheric pressure P1 (approximately 14.7 psi) when the door 122 is open, and once door 122 is closed, the pressure drops to a measured low pressure P2, which in this example is 12.7 psi. This change in pressure ΔP between P1 and P2 is the negative pressure pulse ΔP that indicates a door 122 closure, and its magnitude may be determined by simply noting the difference between the ambient pressure P1 and a low pressure P2 as measured by sensor 140. Additionally, in various embodiments the duration of the negative pressure pulse ΔP may be noted, by determining the time between the P1 and P2 signals. Furthermore, the duration of the drop time DT required to generate the negative pressure pulse ΔP is noted by simply storing the time between the P1 and P2 signals in processor 202 memory 204. Additionally, the time required for the pressure in compartment 120 to return to ambient after door 122 closure, the recovery time RT, may also be measured and stored in memory 204.

In various aspects and embodiments pressure sensor 120 can be continuously monitored when door 122 is closed to determine a "normal" compartment 120, which may be slightly lower or higher than ambient pressure. By continuously monitoring sensor 140 and averaging the compartment 120 pressure while door 122 is closed, a normal pressure P1 may be calculated to be the average pressure over a predetermined number of samples. Thus system 10 in some embodiments calculates an average ambient door closed pressure P1 that indicates a "normal" compartment 120 pressure. As appliance 100 ages, and compartment 120 door 122 seals age over time, system 10 automatically provides a "normal" door closed pressure P1 as a basis to determine when door 122 is properly closed after an opening event, as described in detail herein below.

As best shown in FIGS. 2 and 3, the magnitude of the negative pressure pulse ΔP, the duration of the pressure pulse, DT, and the time required for compartment 120 pressure to recover to normal or ambient RT, collectively included as a plurality of a wide variety of "pressure parameters", may be continuously noted and stored for each door closing event. It should be noted that many different pressure parameters may be measured, stored in memory, and monitored without departing from the scope of the invention. In some aspects and embodiments these parameters, pressure pulse ΔP, duration of the pressure pulse, DT, and the time required for compartment 120 pressure to recover to normal or ambient RT are averaged over a predetermined time period or number of door 122 closing events to provide a standard door closing target profile that is stored in memory 204, to which system 10 then compares each door closing event. Standard door closure target profiles can be produced by measuring and storing each paramater for each compartment 120 of appliance 100. In one exemplary but non-limiting embodiment, where a door 122 closure event is determined by the detection of a negative pressure pulse ΔP, the magnitude of the negative pressure pulse ΔP for that event, as well as the pulse duration time DT and recovery time RT are each compared to the standard door closure target profile stored in memory 204. If any one of these variables is outside of a predetermined acceptable range, processor 202 may provide an indication to a user or service facility through operation of communications interface 230 or user interface 240, indicating a door 122 open alert. In some further aspects and embodiments, where the duration DT of pressure pulse ΔP is shorter than a predetermined time period, processor 202 may provide an indication to a user or service facility through operation of communications interface 230 or user interface 240 that a compartment 120 seal may be failing, since a short duration pulse processor 202 can be an indicator of poor compartment 120 pressurization upon closing, or a door blockage or other maintenance issue.

In yet further aspects and embodiments the standard door closure profile may be an average for the negative pressure pulse ΔP, the pulse duration time DT, and the recovery time RT for a specified number of successful door 122 closing events. In this embodiment, as the door seals and hardware degrade slightly over the useful life of appliance 100, the standard door closure profile will also slightly degrade, thereby continuing to provide a good indication of a positive door 122 closure over the life of the appliance 100. In some embodiments a calibration profile may be produced during production and testing of the appliance, whereby an average of the pressure parameters may be recorded and saved in memory over a predetermined number door closures, thereby establishing a baseline pressure profile for the appliance. In other embodiments, the system 10 may be used to store in data memory 204 historical data regarding an individual compartments' 120 door closure profile characteristics such that a target profile may be determined by an iterative or machine learning process. Additionally and alternatively the system 10 may be used to provide customized target profiles for individual refrigeration compartments 120. In some exemplary but non-limiting embodiments, a target profile may be established during production and manufacturing of an appliance, such that each compartment 120 of an appliance is sold or shipped with an individual target profile stored in data memory 204. These individual compartment 120 profiles may then be updated and modified over time, as more door 122 closing events are monitored by processor 202. In one exemplary embodiment, each compartment 120 target profile includes a predetermined number of door 122 closing data sets, with the oldest data being replaced by the latest door 122 closure data each time a new door 122 closure occurs.

Figure 5:
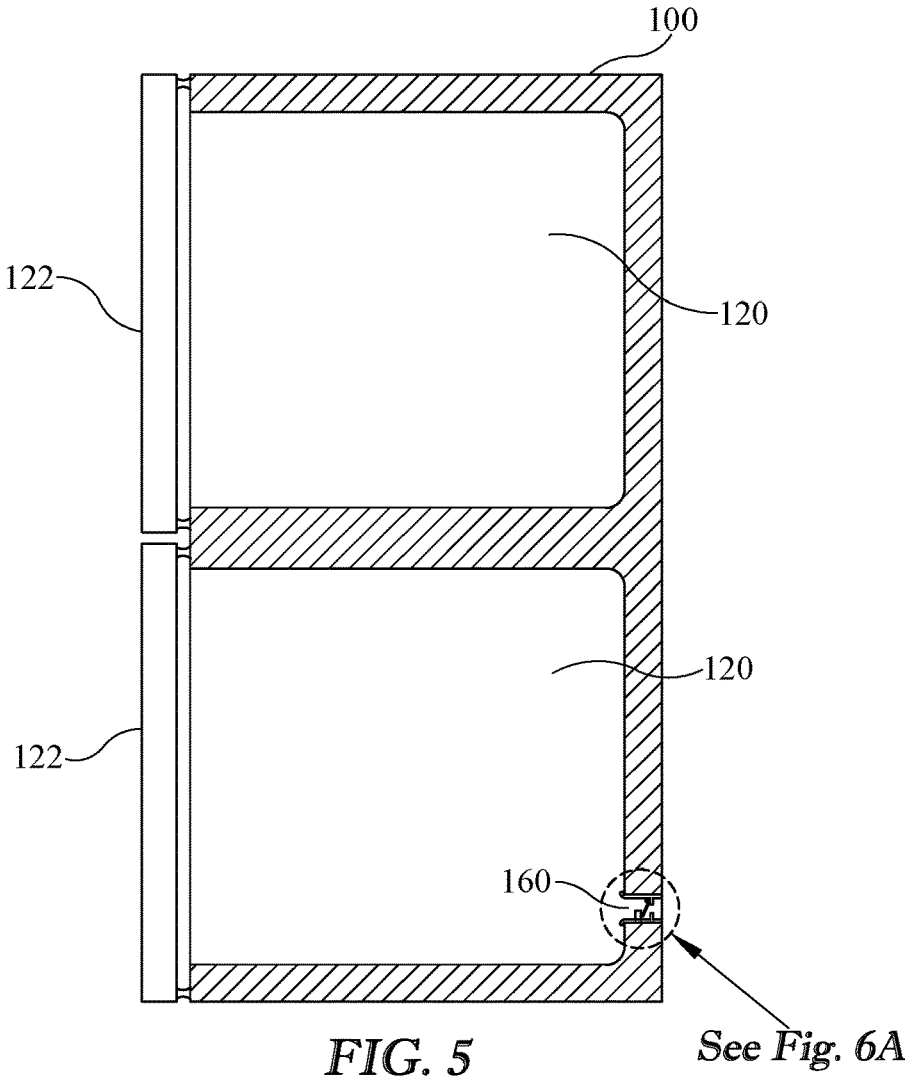
FIG. 5 is a side view of an appliance and negative pressure sensing system in accordance with some aspects and embodiments.
Figure 6A:
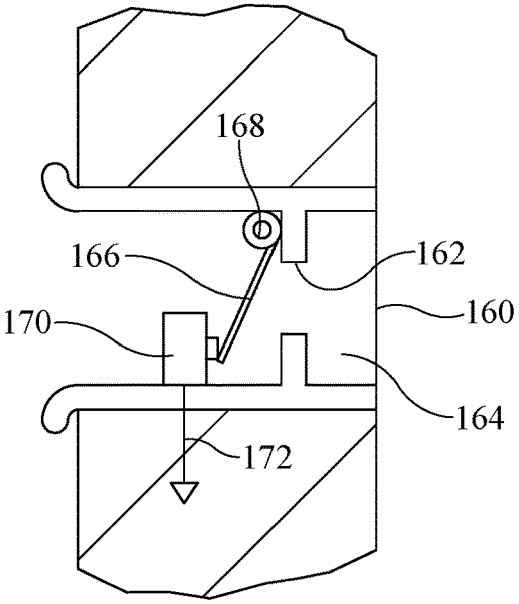
FIG. 6A is a detail view of an appliance and negative pressure sensing system in accordance with some aspects and embodiments.
Figure 6B:
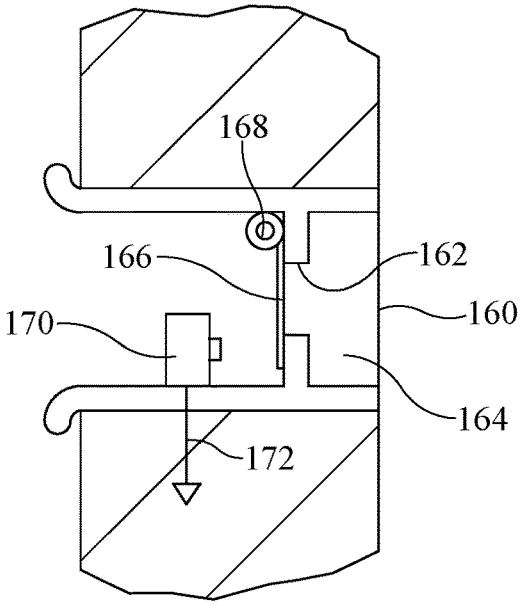
FIG. 6B is a detail view of an appliance and negative pressure sensing system in accordance with some aspects and embodiments.

As depicted in FIGS. 5 and 6, and in one non-limiting exemplary embodiment for purposes of illustration in this specification, a vacuum flap pressure assembly 160 may be provided in an appliance 100 compartment 120, for detecting and monitoring pressure pulse ΔP. Pressure assembly 160 includes an orifice 162 that separates a small space or void 164 from compartment 120. A pivoting flap 168 is further provided, mounted to pivot against the pressure of a torsion spring 168, whereby flap 168 covers orifice 162 when it is only subject to the torsion spring 168 force. When door 122 is opened, the pressure of the opening forces flap 168 to make contact with a micro-switch 170, or an equivalent proximity switch or sensor 170, having an output 172 indicative of a switch 170 closure. In other aspects and embodiments flap 168 may be insulated to reduce heat conduction and/or "sweating".

Flapper assembly 160 provides a mechanical pressure sensing system 10 that may be utilized to determine that a door 122 is closed. Once door 122 closes and the air in compartment 120 rapidly cools and contracts, switch 170 will be contacted by flap 168, thereby providing switch closure output 172 to processor 202, indicating a positive door 122 closure. Additionally and alternatively, flap pressure assembly 160 provides a vacuum break for compartment 120, thereby enabling a user to more easily open door 122 against the normal vacuum forces present in sealed compartments 120.

Figure 7:
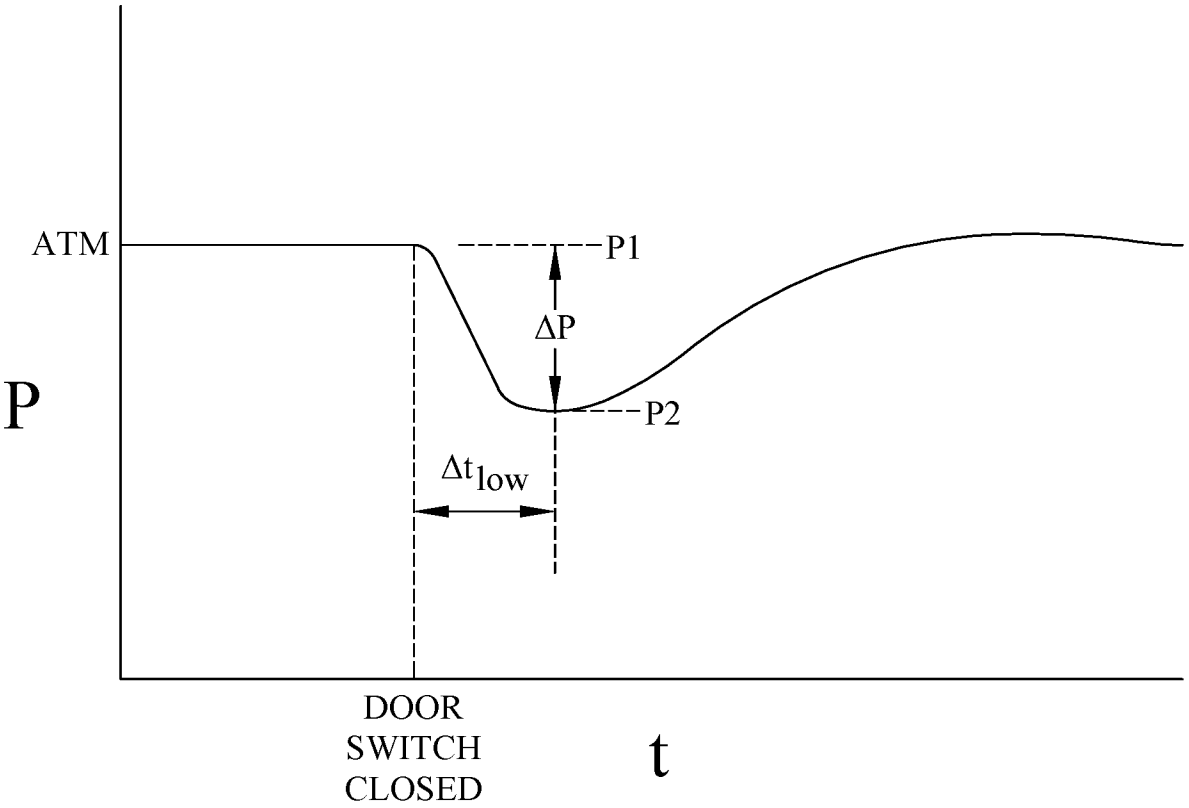
FIG. 7 is a diagram of a negative pressure sensing system in accordance with some aspects and embodiments.

As shown in FIGS. 2, 3 and 7, in some aspects system 10 a method of measuring positive door 122 closure. In this exemplary but non-limiting embodiments wherein compartment 120 includes a mechanical door closure switch 150 for sensing door 122 closure, a pressure sensor 130 may be utilized to construct a target profile that may be monitored to detect an improper door 122 closure or a degradation in compartment 120 performance over time. When a door 122 closure event is detected by door closure switch 150 providing output 152 to processor 202, processor then measures the initial pressure P1 (or alternatively assumes P1 to be atmosphere) and then measures and stores the lowest noted pressure P2, at which point the pressure inside compartment 120 begins to rise again. Processor then subtracts P2 from P1, again determining and storing the pressure drop or pressure pulse ΔP. The pressure pulse ΔP is then compared to a target pressure pulse ΔP as stored in a target profile for compartment 120. If pressure pulse ΔP is within a predetermined tolerance or range, then the door closure event is accepted as a "closed door". In exemplary embodiments pressure pulse ΔP may then be utilized as part of the average measurements for the target pressure pulse ΔP profile.

In some alternative aspects and embodiments a predetermined number of pressure pulse ΔP measurements taken from the initiation of the service life of appliance 100 may be used to construct an average target pressure pulse ΔP profile. If the pressure pulse ΔP detected after a door 122 closure is outside a predetermined range, or alternatively differs more than a predetermined percentage from a pressure pulse ΔP target profile processor 202 may provide an indication to a user or a maintenance warning to an authorized service provider through operation of communications interface 230 or user interface 240 that a compartment 120 seal is operating at reduced efficiency or failing, since a low pressure pulse ΔP can be an indicator of poor compartment 120 pressurization upon closing, or a door blockage or other maintenance issue.

While a variety of inventive embodiments have been described and illustrated herein, those of ordinary skill in the art will understand that a variety of other methods, systems, and/or structures for performing the function and/or obtaining the results, and/or one or more of the advantages described herein are possible, and further understand that each of such variations and/or modifications is within the scope of the inventive embodiments described herein. Those skilled in the art will understand that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. It should be understood that certain expressions and reference signs used in the claims pursuant to Rule 6.2(b) of the Patent Cooperation Treaty ("PCT") do not limit the scope.

What is claimed is:

1. A system for measuring and monitoring the closure of a refrigerated compartment of an appliance comprising:

a controller having at least one input and at least one output for receiving and providing electrical signals to a plurality of electrical components of said appliance;

a pressure sensor for monitoring said compartment having an output representative of compartment pressure operatively coupled to an input of said controller;

said controller configured to;

monitor said pressure sensor output to detect the presence of a negative pressure pulse indicative of a compartment closure;

compare said negative pressure pulse magnitude to a target pressure pulse magnitude; and generate an alert indicating an improper compartment closure based on said comparison.

2. The system of claim 1 comprising:

a user interface operatively coupled to said controller, wherein said controller is further configured to generate the alert indicating the improper compartment closure using the user interface if said negative pressure pulse differs from said target pressure pulse by a predetermined amount.

3. The system of claim 2 wherein said controller is further configured to:

create a calibration pressure profile by monitoring a predetermined number of closures and storing a predetermined number of pressure parameters measured by said sensor, thereby creating a target pressure profile.

4. The system of claim 3 wherein said pressure parameters include the average magnitude of the pressure pulse indicated by said sensor, the average duration of the pressure pulse, and the return time required for the compartment to return to ambient pressure.

5. The system of claim 3 wherein said controller is further configured to:

create a customized pressure profile by monitoring a predetermined number of closures during the use of said appliance and storing the average pressure parameters measured by said sensor, thereby creating a target pressure profile.

6. The system of claim 5 wherein said controller is further configured to compare the pressure pulse magnitude, duration, and return time of a specified compartment closure with said calibration pressure profile to determine proper closure.

7. The system of claim 6 wherein said controller is further configured to generate the alert indicating the improper compartment closure if said negative pressure pulse magnitude, duration or return time differs from said calibration pressure profile by a predetermined amount.

8. A system for measuring and monitoring closure of a refrigerated compartment of an appliance comprising:

a controller and concomitant data memory, said controller having at least one input and at least one output for receiving and providing electrical signals to a plurality of electrical components of said appliance;

a pressure sensor for monitoring said compartment having an output representative of compartment pressure operatively coupled to an input of said controller;

a switch disposed within said compartment capable of detecting at least a partial closure of said compartment;

said controller configured to;

monitor said pressure sensor output to detect the presence of a negative pressure pulse indicative of a compartment closure; and compare said negative pressure pulse magnitude to a target pressure pulse magnitude.

9. The system of claim 8 comprising:

a user interface operatively coupled to said controller, wherein said controller is further configured to provide an indication of an improper compartment closure if said negative pressure pulse differs from said target pressure pulse by a predetermined amount.

10. The system of claim 9 wherein said controller is further configured to:

for each compartment closure store the magnitude of the pressure pulse indicated by said sensor, store the duration of the pressure pulse, and store the return time required for the compartment to return to ambient pressure, thereby creating a calibration pressure profile.

11. The system of claim 10 wherein said controller is further configured to average the pressure pulse magnitude, duration, and return time over a predetermined number of door closures during operation of said appliance to create a customized target pressure profile.

12. The system of claim 11 wherein said controller is further configured to compare the pressure pulse magnitude, duration, and return time of a specified door closure with said target pressure profile to determine proper door closure.

13. The system of claim 12 wherein said controller is further configured to provide an indication of an improper door closure if said negative pressure pulse magnitude, duration or return time differs from said target pressure profile by a predetermined amount.

14. A system for measuring and monitoring closure of a refrigerated compartment of an appliance comprising:

a controller and concomitant data memory, said controller having at least one input and at least one output for receiving and providing electrical signals to a plurality of electrical components of said appliance;

a vacuum flap pressure assembly disposed in said compartment for detecting and monitoring a pressure pulse, said flap pressure assembly having an orifice that separates a void from said compartment, and having a pivoting flap mounted to pivot against the pressure of a torsion spring, whereby said flap covers said orifice when it is only subject to the torsion spring force; and a micro-switch having an output operatively coupled to an input of said controller, said micro-switch being engaged to provide said output by said pivoting flap at a predetermined compartment pressure;

said controller configured to;

monitor said pressure sensor output to detect the presence of a negative pressure pulse indicative of a compartment closure; and compare said negative pressure pulse magnitude to a target pressure pulse magnitude.

15. The system of claim 14 wherein said micro-switch output is indicative of proper compartment closure.

16. The system of claim 14 wherein said vacuum flap pressure assembly provides a vacuum break for said compartment.

17. A system for measuring and monitoring closure of a refrigerated compartment of an appliance comprising:

a controller and concomitant data memory, said controller having at least one input and at least one output for receiving and providing electrical signals to a plurality of electrical components of said appliance;

a vacuum flap pressure assembly disposed in said compartment for detecting and monitoring a pressure pulse, said flap pressure assembly having an orifice that separates a void from said compartment, and having a pivoting flap biased to cover said orifice and configured to pivot and open said orifice in response to the pressure pulse; and a micro-switch having an output operatively coupled to an input of said controller, said micro-switch being engaged to provide said output by said pivoting flap at a predetermined compartment pressure;

said controller configured to;

monitor said pressure sensor output to detect the presence of a negative pressure pulse indicative of a compartment closure; and compare said negative pressure pulse magnitude to a target pressure pulse magnitude.

18. The system of claim 17 wherein said micro-switch output is indicative of proper compartment closure.

19. The system of claim 17 wherein said vacuum flap pressure assembly provides a vacuum break for said compartment.

20. The system of claim 17 further comprising a torsion spring coupled to said pivoting flap to provide the bias that covers said orifice.

* * * * *